US006571475B1

(12) United States Patent
Tomei

(10) Patent No.: US 6,571,475 B1
(45) Date of Patent: Jun. 3, 2003

(54) METHOD OF CHAMFERING AND DEBURRING GEAR TEETH, DEVICE IMPLEMENTING SUCH A METHOD, AND RELATIVE TOOL

(75) Inventor: Umberto Tomei, Castenaso (IT)

(73) Assignee: Samputensili S.p.A., Via Triumvirato (IT)

( * ) Notice: Subject to any disclaimer, the term of this patent is extended or adjusted under 35 U.S.C. 154(b) by 0 days.

(21) Appl. No.: 09/544,859

(22) Filed: Apr. 7, 2000

(30) Foreign Application Priority Data

Apr. 9, 1999 (IT) ..... BO99A0164

(51) Int. Cl.[7] ..... B21D 53/28

(52) U.S. Cl. ..... 29/893.32; 29/893.3; 29/893.35; 72/102; 407/28; 409/8

(58) Field of Search ..... 29/893.3, 90.6, 29/893.32, 893.35; 72/102; 407/27, 28; 409/4, 8, 9

(56) References Cited

U.S. PATENT DOCUMENTS

| | | | | |
|---|---|---|---|---|
| 3,735,619 A | 5/1973 | Tersch | ..... | 72/98 |
| 4,290,718 A | 9/1981 | Occhialini | ..... | 409/8 |

FOREIGN PATENT DOCUMENTS

| | | |
|---|---|---|
| DE | 8307877 | 4/1984 |
| DE | 4130927 | 6/1992 |
| DE | 29715092 | 10/1997 |
| FR | 2091329 | 1/1972 |
| FR | 2225244 | 11/1974 |

OTHER PUBLICATIONS

Nyamagoudar, B.; *Chamfering and Deburrig External Parallel Axis Gears*; Gear Technology, vol. 13, No. 6, Nov. 1, 1996; (pp. 25–31, XP000691319).

European Search Report for Application No. EP 00 10 7582 dated Jul. 24, 2000; (4 pp.).

*Primary Examiner*—P. W. Echols
(74) *Attorney, Agent, or Firm*—Birch, Stewart, Kolasch & Birch, LLP

(57) ABSTRACT

A method of chamfering and deburring the teeth of a gear having first teeth, each of the first teeth having a first and a second side and respective end faces; the method providing for meshing the gear with at least one tool having a ring gear meshing with the first teeth at edges formed between the first and second sides and the end faces; exerting compression between the first teeth of the gear and the ring gear; effecting a first permanent deformation of the edges to form first chamfer faces; and effecting at least a second permanent deformation between the first and second sides and the respective end faces; the first and the second permanent deformation being effected by means of enbloc tools having a first number of teeth and a second number of teeth.

19 Claims, 5 Drawing Sheets

METHOD OF CHAMFERING AND DEBURRING GEAR TEETH, DEVICE IMPLEMENTING SUCH A METHOD, AND RELATIVE TOOL

The present invention relates to a method of chamfering and deburring gear teeth.

In particular, the present invention relates to a method of chamfering and deburring helical gears, to which the following description refers purely by way of example.

BACKGROUND OF THE INVENTION

Gears normally comprise teeth defined by respective sides and end faces, which, with the sides, form sharp edges along which burrs are left after chip-forming machining, and which must therefore be chamfered for the gear to work and mesh properly.

One known deburring and chamfering method employs a tool featuring a ring gear comprising a number of teeth, which are brought into contact with and pressed against the sharp edges to deform them permanently and form bevels between the sides and end faces of the gear teeth.

A major drawback of the above known method, however, lies in the formation of curls projecting from the gear teeth and partly inside the gaps between the teeth, and which are formed by the permanently deformed material of the tooth, and seriously impair operation of the gear, particularly in the case of high-precision gears. The problem is further compounded in the case of gears which are ground after heat treatment, in which case, the hardened curls may indent the grinding tool.

SUMMARY OF THE INVENTION

It is an object of the present invention to provide a gear chamfering and deburring method designed to eliminate the above drawbacks.

According to the present invention, there is provided a method, as claimed in claim 1, designed to eliminate the aforementioned drawbacks.

The present invention also relates to a chamfering and deburring tool.

The present invention also relates to a chamfering and deburring device.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
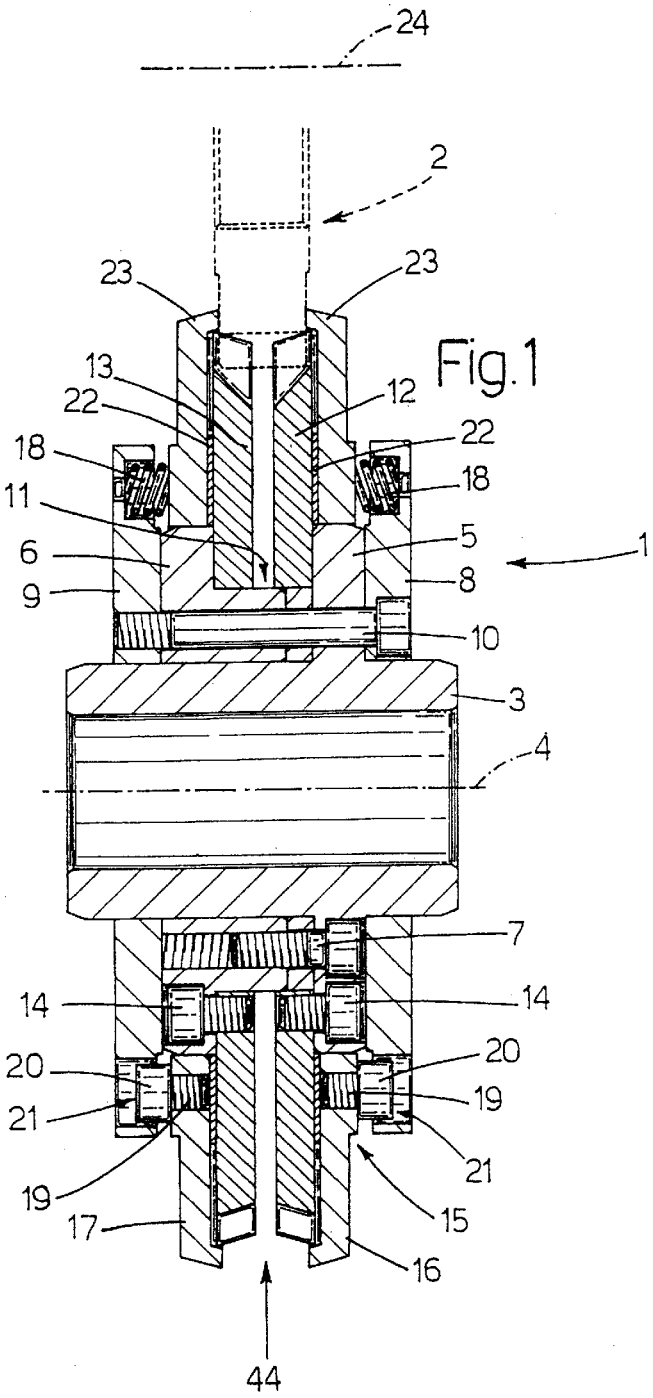
FIG. 1 shows a small-scale section, with parts removed for clarity, of a device in accordance with the present invention.

Number 1 in FIG. 1 indicates as a whole a device for chamfering and deburring the teeth of a gear 2 shown by the dash lines in FIG. 1. Device 1 comprises a hub 3 and an axis 4 of rotation and symmetry. Hub 3 is fitted to a known shaft (not shown) and comprises a ring 5 integral with hub 3 and extending radially; an L-section ring 6 fitted to ring 5 by screws 7 (only one shown in FIG. 1); and two annular disks 8 and 9 fitted to ring 5 by screws 10 (only one shown in FIG. 1).

Rings 5 and 6 define an annular seat 11 housing two tools 12 and 13, which are in the form of annular disks facing and parallel to each other, are fitted to respective rings 5 and 6 by means of screws 14, and are located a given axial distance apart.

Disk 8 is located on the opposite side of rings 5 and 6 to disk 9. Disks 8 and 9 are positioned facing and parallel to each other, and define a seat 15 housing two annular deburring disks 16 and 17 facing and parallel to each other and adjacent to respective tools 12 and 13. Disks 16 and 17 rest on respective rings 5 and 6, and are pushed towards each other by springs 18 located between disks 8, 9 and respective disks 16, 17.

Disks 16 and 17 comprise screws 19 fitted to disks 16 and 17 and in turn comprising respective heads 20 projecting axially with respect to disks 16 and 17 and housed inside respective seats 21 formed in disks 8 and 9.

Device 1 also comprises two disks 22 located between deburring disks 16, 17 and respective tools 12, 13. That is, whereas tools 12 and 13 are fitted rigidly to hub 3, deburring disks 16 and 17 are allowed to slide axially by a limited amount with respect to hub 3.

Deburring disks 16 and 17 have respective outer peripheral edges 23 bent towards each other at the outer peripheries of respective tools 12 and 13, and having cutting edges for deburring the sides of gear 2.

Gear 2 is connected to device 1 and mounted for rotation about a respective axis 24 parallel to axis 4.

The following description with reference to FIGS. 2, 3, 4*a* and 4*b* refers for the sake of simplicity to tool 12, it being understood, however, that the same also applies to tool 13.

Figure 2:
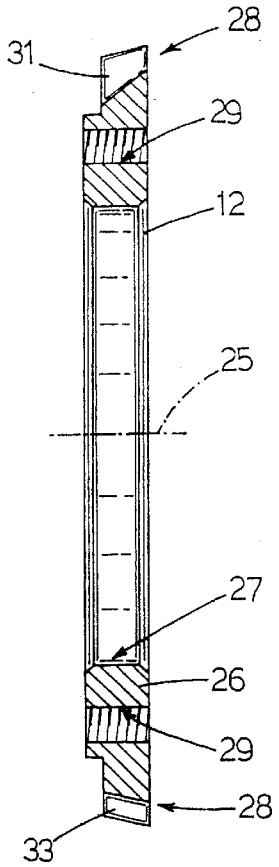
FIG. 2 shows a section, with parts removed for clarity, of a tool of the FIG. 1 device.

With reference to FIG. 2, tool 12 comprises an axis 25 coincident, in use, with axis 4 of device 1; an annular disk 26 having a central hole 27; and a ring gear 28 integral with disk 26. Annular disk 26 has a number of threaded holes 29 equally spaced about axis 25 and which are engaged, in use, by screws 14 (FIG. 1).

Figures 3, 3A, 3B:
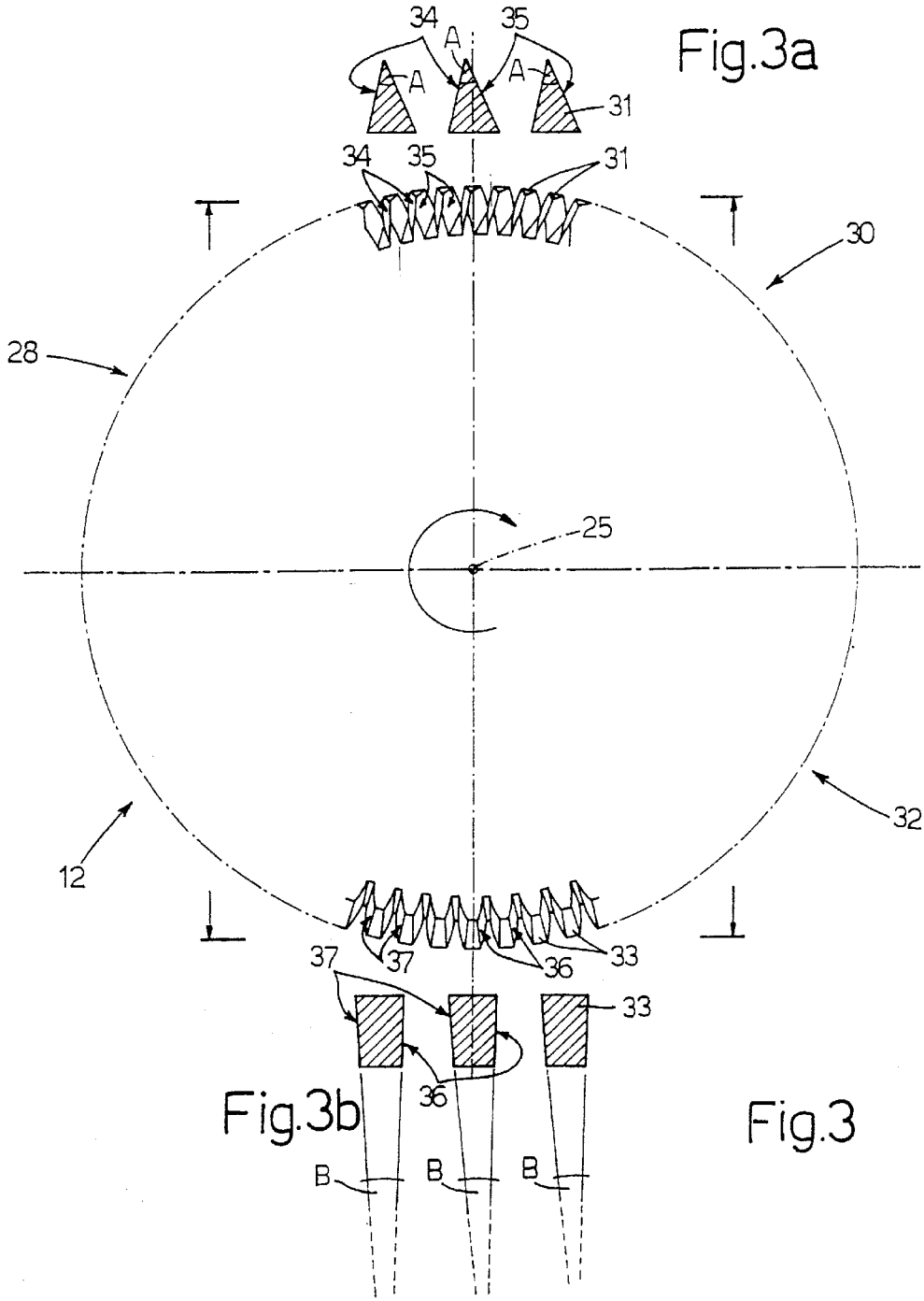
FIG. 3 shows a view in perspective, with parts removed for clarity, of the FIG. 2 tool.
FIGS. 3*a* and 3*b* show sections of the FIG. 3 tool.
Figures 4, 4A, 4B:
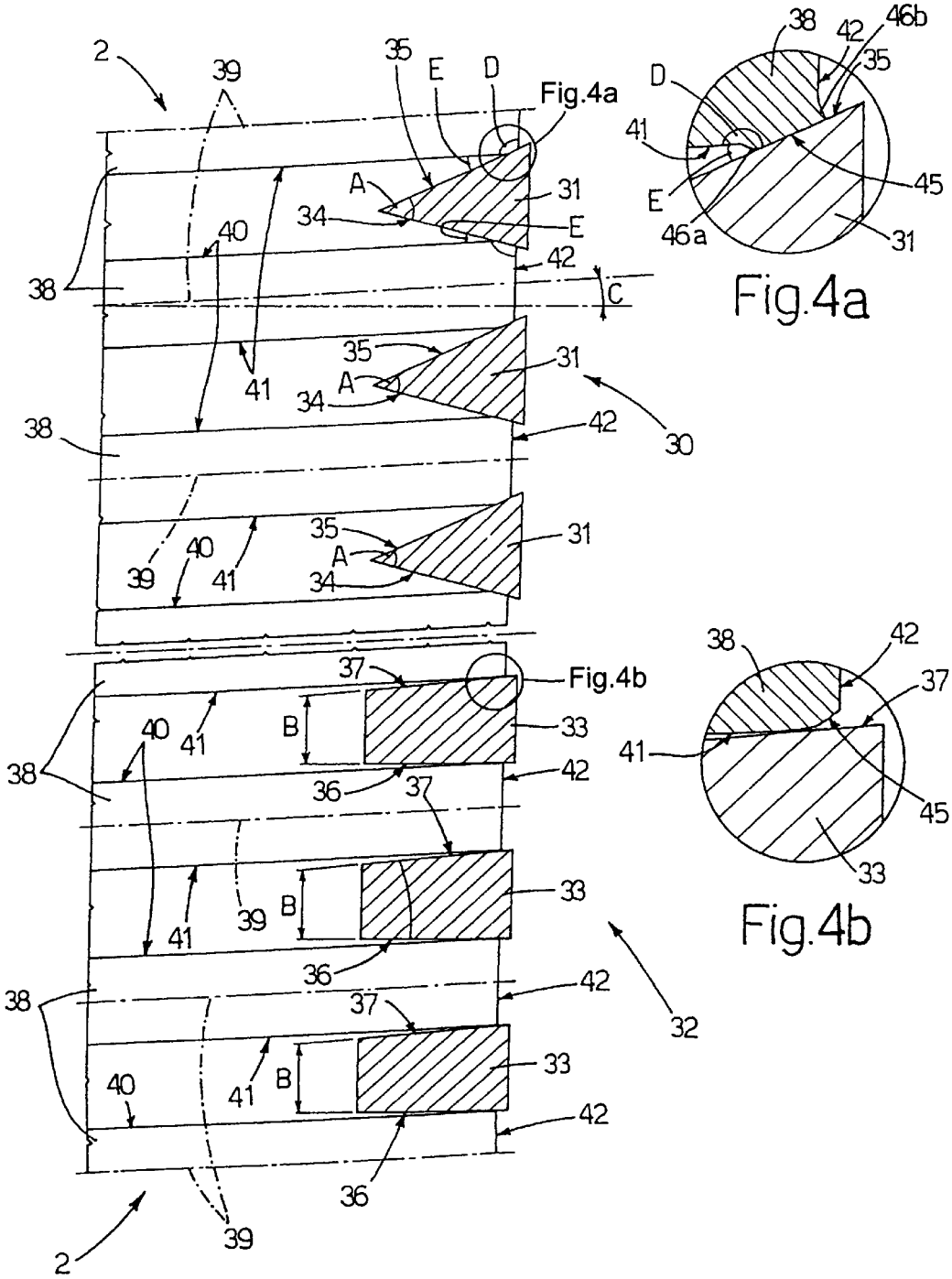
FIG. 4 shows a developed view of a gear engaged by the FIGS. 2 and 3 tool at two stages in the method according to the present invention.
FIGS. 4*a* and 4*b* show sections of the FIG. 4 tool.

With reference to FIGS. 3*a* and 4*a*, each tooth 31 comprises sides 34 and 35 forming an acute angle A ranging between 0° and 90°. With reference to FIGS. 3*b* and 4*b*, each tooth 33 comprises sides 36 and 37 forming an acute angle B that is preferably considerably smaller than angle A and ranging between 0° and 15°.

With reference to FIGS. 3*a* and 4*a*, each tooth 31 comprises sides 34 and 35 forming an acute angle A ranging between 0° and 90°. With reference to FIGS. 3*b* and 4*b*, each tooth 33 comprises sides 36 and 37 forming an acute angle B considerably smaller than angle A and ranging between 0° and 15°.

With reference to FIGS. 4*a* and 4*b*, gear 2 comprises a succession of helical teeth 38, each of which has a respective axis 39 inclined at an angle C with respect to a direction parallel to axis 24. Each tooth 38 comprises two sides 40 and 41 parallel to axis 39; and two end faces 42 parallel to each other and perpendicular to axis 24 of gear 2.

With reference to FIG. 1, in actual use, gear 2 is aligned with tools 12 and 13, with axis 24 parallel to axis 4 of device 1, so as to mesh with tools 12 and 13; a known device (not shown) applies pressure between gear 2 and device 1 in direction 44 to push tools 12 and 13 against gear 2; deburring disks 16 and 17 push respective edges 23 into contact with the sides of gear; and springs 18 press edges 23 against the sides of gear 2.

With reference to FIG. 4*a*, portion 30 of ring gear 28 of tool 12, viewed in section, engages gear 2 on one side of gear 2, with teeth 31 located successively between respective teeth 38 of gear 2. More specifically, side 35 of each tooth 31 is positioned contacting an edge between side 41 and respective end face 42 of one tooth 38, while side 34 of tooth 31 is positioned contacting an edge between side 40 and the respective end face of an adjacent tooth 38. Gradual forced insertion of teeth 31 between teeth 38 of gear 2 and the pressure exerted in direction 44 between gear 2 and device 1 produce considerable pressure between faces 34 and 35 of each tooth 31 and the edges of two successive, adjacent teeth 38, so as to permanently deform the edges as shown in the enlarged detail of FIG. 4*a*. Permanent deformation of the edges is such as to flatten the edges and form respective chamfer faces 45 between respective sides 40 and 41 and respective end faces 42, and to also form a curl 46*a* on the side of tooth 38, and a curl 46*b* on face 42 (FIG. 4*a*).

That is, each tooth 31 forms, by permanent deformation, chamfer faces 45 on sides 40 and 41 of two adjacent teeth 38 of gear 2. Chamfer faces 45 are inclined, with respect to respective sides 40 and 41, at an angle D, which is a complement of 180° with the inclination E of faces 34 and 35 with respect to the axes 39 of teeth 38. Tests have shown gears 2 to operate best with an inclination E ranging between 5° and 45°.

With reference to FIG. 4*b*, portion 32 of ring gear 28 of tool 12, viewed in section, engages one side of gear 2, with teeth 33 located successively between respective teeth 38 of gear 2. More specifically, side 37 of each tooth 33 is positioned contacting curl 46*a* between side 41 and respective chamfer face 45, while side 36 of tooth 33 is positioned contacting curl 46*a* between side 40 and respective chamfer face 45 of an adjacent tooth 38. Like teeth 31, the pressure exerted in direction 44 produces considerable pressure between faces 36 and 37 and curls 46*a*, so as to deform curls 46*a* as shown in the enlarged detail of FIG. 4*b*. Deformation of curls 46*a* is a permanent deformation by which curls 46*a* are flattened and "ironed out" so to speak on to sides 41, while curls 46*b* projecting from end faces 42 of tooth 38 are removed by cutting edges 23 of deburring disks 16, 17.

Figures 5, 5A:
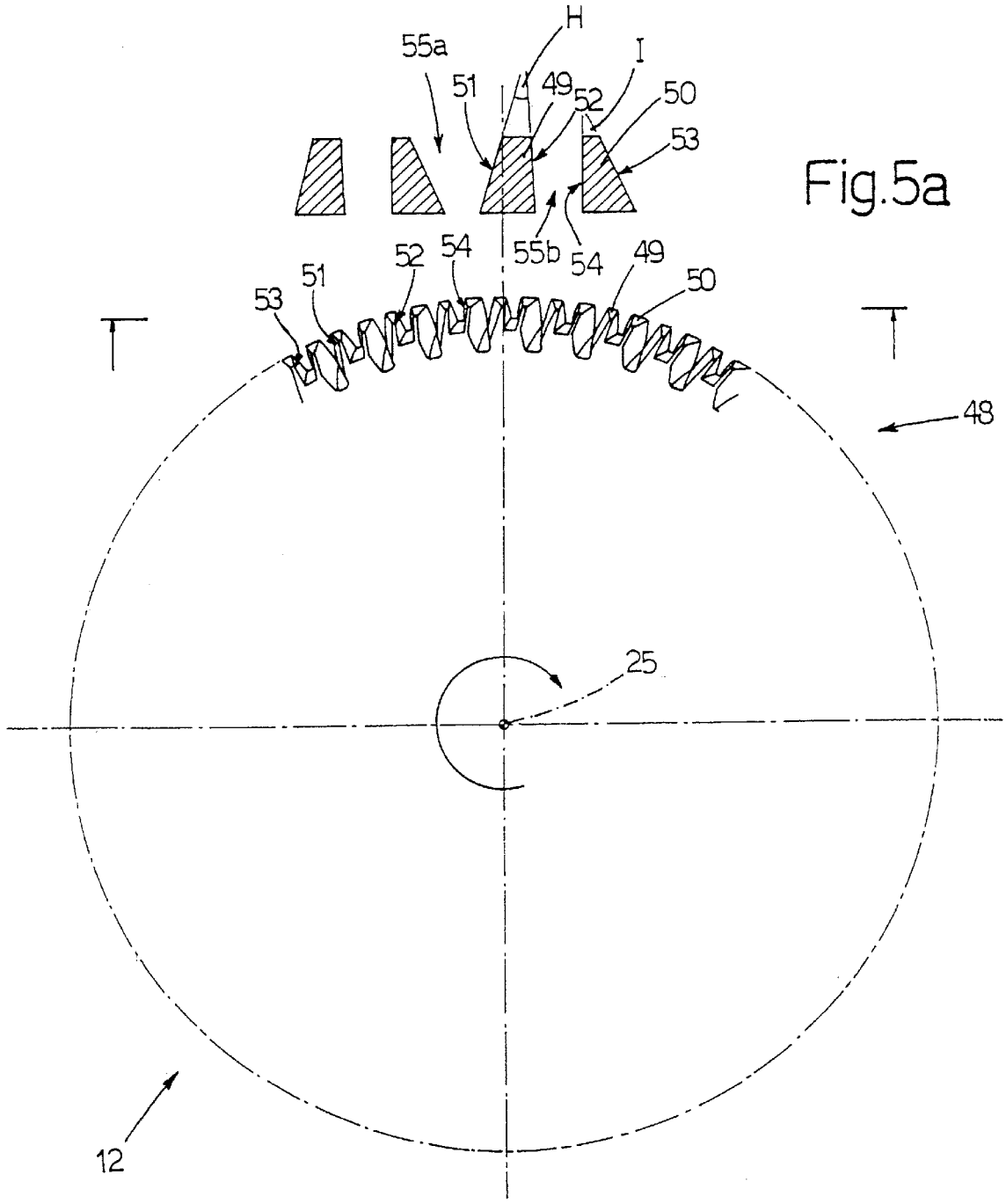
FIG. 5 shows a view in perspective, with parts removed for clarity, of a variation of the FIG. 1 device tool.
FIG. 5*a* shows a section of the FIG. 5 tool.
Figure 6:
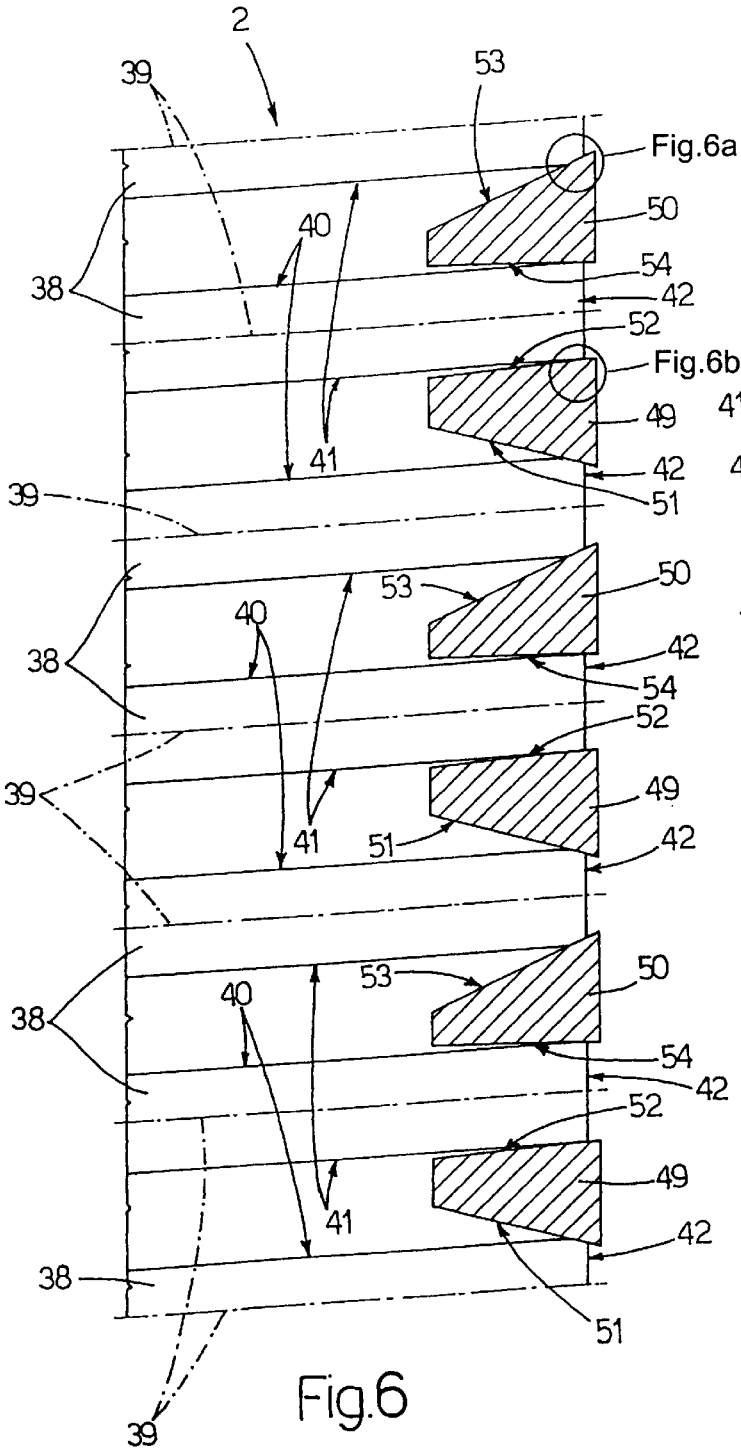
FIG. 6 shows a developed view of a gear engaged by the FIG. 5 tool.
Figure 6A:
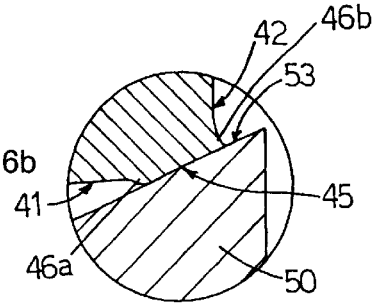
FIGS. 6*a* and 6*b* show sections of the FIG. 6 tool.
Figure 6B:
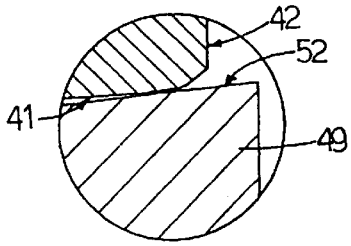

In the variation shown in FIGS. 5, 5*a* and 6, tool 12 comprises a ring gear 48 in turn comprising teeth 49 and teeth 50 equally spaced and alternating with each other about ring gear 48.

Each tooth 49 comprises a side 51 inclined at a given angle with respect to a direction parallel to axis 25, and a side 52 inclined with respect to axis 25 at a smaller angle than side 51; and sides 51 and 52 of each tooth 49 form an angle H comparable to angle B in the FIG. 3 embodiment. Each tooth 50 comprises a side 53 inclined at a given angle with respect to axis 25, and a side 54 inclined with respect to axis 25 at a given angle considerably smaller than that of side 53; and sides 53 and 54 of each tooth 50 form an angle I comparable to angle A in the FIG. 3 embodiment. Teeth 49 and 50 are so arranged that side 51 of each tooth 49 faces side 53 of the adjacent tooth 50 on one side, and side 52 faces side 54 of the adjacent tooth 50 on the opposite side, and so that flared gaps 55*a* of a given size between sides 51 and 53 of adjacent teeth 49 and 50 alternate about ring gear 48 with flared gaps 55*b* formed between sides 52 and 54 of respective teeth 49 and 50 and considerably smaller than gaps 55*a*.

With reference to FIG. 6, in actual use, ring gear 48 of tool 12, viewed in section, engages gear 2 on one side, with teeth 49 and 50 located successively between respective teeth 38 of gear 2. More specifically, sides 51, 52 and 53, 54 of respective teeth 49 and 50 are brought into contact with the edges between sides 40 and 41 and end faces 42 of gear 2. In particular, the edge between side 41 and end face 42 of each tooth 38 contacts side 53; and, as in the FIG. 3 embodiment, side 53 of tooth 50 forms, by permanent deformation, chamfer face 45 between side 41 and face 42.

The edge between side 40 and end face 42 contacts side 51; tooth 49, by means of a respective side 51, forms, by permanent deformation, chamfer face 45 between side 40 and respective end face 42; and the formation of chamfer face 45 produces a respective curl 46*a*, which is eliminated by further permanent deformation by the pressure exerted by faces 52 and 54 of respective teeth 49 and 50. In other words, each side 41 is brought into contact with a respective side 52 of a tooth 49, which provides for further permanent deformation by exerting pressure on curl 46*a*. Similarly, each side 40 is brought into contact with a respective side 54 of a respective tooth 50, which provides for further permanent deformation by exerting pressure on curl 46*a*. As in the FIG. 3 embodiment, the outer curl 46*b* is removed by cutting edges 23 of disks 16, 17.

The main characteristics of the present invention may be summed up as follows:

(a) double permanent deformation to form the edge between the side and one face, and to flatten the inside curl on the side of the gear tooth;

(b) highly compact tools 12, 13, the ring gears 28, 48 of which are formed in one piece with respective disks 26, thus reducing production and storage cost of tools 12, 13;

(c) highly straightforward timing of the chamfer-face-forming and curl-flattening teeth;

(d) the axial distance between tools 12 and 13 of the same device may be varied extremely easily to work gears 2 of different axial widths, while at the same time maintaining the same angle C of inclination of the spiral of the teeth of gear 2; and (e) within certain limits, a device comprising two tools 12, 13 may be used to work gears 2 with slightly differing angles C of inclination of the teeth, by simply rotating one tool 12, 13 with respect to the other 13, 12 depending on the difference in the angle C of inclination of the teeth of gear 2.

What is claimed is:

1. A method of chamfering and deburring the teeth of a gear, each of the teeth having a first and a second side and respective first and second end faces, the method comprising:

meshing the gear with first and second tools, each tool comprising a ring gear having first and second tool teeth meshing with the gear teeth at edges formed between the first and second sides and, respectively, the first and second end faces;

exerting compression between the gear teeth and the first tool teeth, thereby effecting a first permanent deformation of the gear teeth between, respectively, the first and second sides and the first and second end faces to form a chamfer having a first curl on, respectively, the first and second sides and a second curl on, respectively, the first and second end faces; and exerting compression between the gear teeth and the second tool teeth, thereby effecting a second permanent deformation of the gear teeth between, respectively, the first and second sides and the first and second end faces to flatten said first curl of the chamfer on the first and second sides.

2. The method as claimed in claim 1, wherein:

each tooth of the first tool teeth simultaneously forms two chamfers on two adjacent gear teeth, and each tooth of the second tool teeth provides for flattening said first curls on the chamfer of the two adjacent gear teeth.

3. The method as claimed in claim 1, wherein each tooth of the first tool teeth and each tooth of the second tool teeth form, by one side of each tool tooth, the chamfer on one side of each gear tooth and, by the opposite side of each tool tooth, provide for flattening said first curls of the chamfer on an opposite side of an adjacent gear tooth.

4. The method as claimed in claim 1, further comprising the steps of:

providing first and second deburring disks adjacent to, respectively, said first and second tools; and deburring said second curls on said first and second end faces with, respectively, said first and second deburring disks.

5. A tool for chamfering and deburring the teeth of a gear, each gear tooth having first and second sides and first and second end faces, the tool comprising:

a ring gear having first tool teeth and second tool teeth adapted for meshing with the gear teeth at edges formed between the first and second sides and, respectively, an end face thereof, said first tool teeth respectively effecting a first permanent deformation of the gear teeth to form a chamfer having a first curl on, respectively, the first and second sides and a second curl on, respectively, the end face, and said second tool teeth respectively effecting a second permanent deformation to flatten said first curl of the chamfer on the first and second sides, wherein said first tool teeth are adjacent to each other, each tooth meshing with two adjacent said gear teeth to effect said first permanent deformation; and said second tool teeth are adjacent to each other, each tooth meshing with two adjacent said gear teeth to effect said second permanent deformation.

6. The tool as claimed in claim 5, wherein said ring gear comprises at least a first and at least a second portion with said at least a first and at least a second portion being complementary to each other, said at least a first portion comprising said first tool teeth, and said at least a second portion comprising said second tool teeth.

7. The tool as claimed in claim 6, wherein in said first tool teeth, each tooth has respective sides forming a first angle; and in said second tool teeth each tooth has respective sides forming a second angle; said second angle being smaller than said first angle.

8. The tool as claimed in claim 7, wherein said second angle ranges between 0° and 15°.

9. The tool as claimed in claim 7, wherein said first angle ranges between 0° and 90°.

10. A device for implementing the method as claimed in claim 1, comprising at least one tool as claimed in claim 5; said at least one tool rotating about an axis.

11. The device as claimed in claim 10, further comprising at least one deburring disk rotating about said axis, each said deburring disk deburring said second curl on, respectively, the first and second end faces of the gear teeth.

12. The tool as claimed in claim 5, further comprising:

a second ring gear having first and second tool teeth adapted for meshing with the gear teeth at edges formed between the first and second sides and respectively, an opposite end face thereof, said first tool teeth of the second ring gear respectively effecting a first permanent deformation of the gear teeth to form a chamfer having a first curl on, respectively, the first and second sides and a second curl on, respectively, the opposite end face, and said second tool teeth of the second ring gear respectively effecting a second permanent deformation to flatten said first curl of the chamfer on the first and second sides.

13. The tool as claimed in claim 12, further comprising first and second deburring disks adjacent to, respectively, said first and second ring gears, said first and second deburring disks deburring said second curls on, respectively, said end face and said opposite end face of the gear teeth.

14. A tool for chamfering and deburring the teeth of a gear each gear tooth having first and second sides and first and second end faces, the tool comprising:

a ring gear having first tool teeth and second tool teeth adapted for meshing with the gear teeth at edges formed between the first and second sides and, respectively, an end face thereof, said first tool teeth respectively effecting a first permanent deformation of the gear teeth to form a chamfer having a first curl on, respectively, the first and second sides and a second curl on, respectively, the end face, and said second tool teeth respectively effecting a second permanent deformation to flatten said first curl of the chamfer on the first and second sides, wherein said ring gear comprises at least a first and at least a second portion with said at least a first and at least a second portion being complementary to each other, said at least a first portion comprising said first tool teeth, and said at least a second portion comprising said second tool teeth.

15. The tool as claimed in claim 14, wherein in said first tool teeth, each tooth has respective sides forming a first angle; and in said second tool teeth each tooth has respective sides forming a second angle; said second angle being smaller than said first angle.

16. The tool as claimed in claim 15, wherein said second angle ranges between 0° and 15°.

17. The tool as claimed in claim 15, wherein said first angle ranges between 0° and 90°.

18. A device for implementing the method as claimed in claim 1, comprising at least one tool as claimed in claim 14; said at least one tool rotating about an axis.

19. The device as claimed in claim 18, further comprising at least one deburring disk rotating about said axis, each said deburring disk deburring said second curl on, respectively, the first and second end faces of the gear teeth.

* * * * *